US005775148A

United States Patent [19]

Layton et al.

[11] Patent Number: 5,775,148

[45] Date of Patent: Jul. 7, 1998

[54] UNIVERSAL APPARATUS FOR USE WITH ELECTRONIC AND/OR MECHANICAL ACCESS CONTROL DEVICES

[75] Inventors: Tim W. Layton, Roanoke; Richard Hyatt, Jr., Shawsville, both of Va.

[73] Assignee: Medeco Security Locks, Inc., Salem, Va.

[21] Appl. No.: 876,291

[22] Filed: Jun. 16, 1997

Related U.S. Application Data

[63] Continuation of Ser. No. 404,879, Mar. 16, 1995, abandoned.

[51] Int. Cl.[6] ..... E05B 19/04

[52] U.S. Cl. ..... 70/408; 70/393; 70/395

[58] Field of Search ..... 70/408, 395, 413, 70/400, 403, 411, 460, 278, 252, 393

[56] References Cited

U.S. PATENT DOCUMENTS

| | | | |
|---|---|---|---|
| Re. 33,873 | 4/1992 | Romano . | |
| 1,837,114 | 12/1931 | Cicourel | 70/408 |
| 2,882,455 | 4/1959 | Ferguson, Jr. . | |
| 3,085,149 | 4/1963 | Giworsky | 362/116 |
| 3,347,072 | 10/1967 | Rose . | |
| 3,349,589 | 10/1967 | Fricke | 70/408 |
| 3,392,558 | 7/1968 | Hedin et al. . | |
| 3,641,316 | 2/1972 | Dethloff et al. . | |
| 3,672,191 | 6/1972 | Regan . | |
| 3,702,464 | 11/1972 | Castrucci . | |
| 3,829,833 | 8/1974 | Freeny, Jr. . | |
| 3,876,884 | 4/1975 | Housman et al. . | |
| 3,902,075 | 8/1975 | Oros . | |
| 3,984,658 | 10/1976 | Cannon . | |
| 4,102,166 | 7/1978 | Hughes | 70/456 |
| 4,196,347 | 4/1980 | Hadley . | |
| 4,200,227 | 4/1980 | Lemelson | 235/382 |
| 4,250,533 | 2/1981 | Nelson . | |
| 4,286,305 | 8/1981 | Pilat et al. . | |
| 4,296,402 | 10/1981 | Szczpanski . | |
| 4,379,966 | 4/1983 | Flies . | |
| 4,409,471 | 10/1983 | Aigo . | |
| 4,412,216 | 10/1983 | Mole et al. . | |
| 4,416,127 | 11/1983 | Gomez-Olea Naveda . | |
| 4,420,794 | 12/1983 | Anderson . | |
| 4,436,993 | 3/1984 | Flies . | |
| 4,549,076 | 10/1985 | Flies . | |
| 4,562,712 | 1/1986 | Wolter | 70/456 |
| 4,578,573 | 3/1986 | Flies et al. . | |
| 4,642,734 | 2/1987 | Anderson . | |
| 4,659,915 | 4/1987 | Flies . | |
| 4,682,017 | 7/1987 | Nakahara et al. . | |
| 4,686,358 | 8/1987 | Seckinger et al. | 235/382 |
| 4,706,084 | 11/1987 | Meyers et al. . | |

(List continued on next page.)

FOREIGN PATENT DOCUMENTS

| | | | |
|---|---|---|---|
| 2078188 | 4/1993 | Canada | E05B 47/00 |
| 0224607 | 6/1987 | European Pat. Off. . | |
| 2712759 | 9/1978 | Germany . | |
| 3521417 | 5/1986 | Germany . | |
| 32348 | 11/1995 | WIPO . | |

*Primary Examiner*—Steven N. Meyers
*Assistant Examiner*—Tuyet-Phuong Pham
*Attorney, Agent, or Firm*—Rothwell, Figg, Ernst & Kurz

[57] ABSTRACT

An apparatus for use with electronic and/or mechanical access control devices includes a holder which receives a removable insert which may include an electronic module with a cover member securing the insert to the holder. The holder may take various forms and may be in the form of a key ring, photo I.D. card, etc. The holder may be a key blank for forming a key that operates mechanical locks, in which case the insert may be a dummy insert or it may include electronic components for operating various types of electronic access control devices. A method of upgrading a key for operating a mechanical lock to a key for also operating an electronic access device is provided and involves replacing the insert in the key with an insert containing electronic components. The electronic components may utilize various technologies such as proximity-based access control.

14 Claims, 7 Drawing Sheets

U.S. PATENT DOCUMENTS 4,726,205 2/1988 Allerdist et al. ..... 70/395
4,734,693 3/1988 Dluhosch et al. .
4,738,334 4/1988 Weishaupt .
4,789,859 12/1988 Clarkson et al. .
4,833,465 5/1989 Abend et al. .
4,835,407 5/1989 Kataoka et al. .
4,848,115 7/1989 Clarkson et al. .
4,849,749 7/1989 Fukamachi et al. .
4,868,409 9/1989 Tanaka et al. .
4,871,886 10/1989 Vaughan et al. .
4,888,970 12/1989 Kinzler et al. .
4,891,636 1/1990 Rieker .
4,922,736 5/1990 Tanaka et al. .
4,924,686 5/1990 Vonlanthen .
4,937,437 6/1990 Ferguson .
4,947,662 8/1990 Imedio .
4,964,023 10/1990 Nishizawa et al. .
4,980,680 12/1990 Knoll et al. .
4,998,952 3/1991 Hyatt, Jr. et al. ..... 70/395
5,003,801 4/1991 Stinar et al. .
5,023,605 6/1991 McColl .
5,038,590 8/1991 Sawyer et al. ..... 70/458
5,043,593 8/1991 Tsutsumi et al. .
5,083,362 1/1992 Edgar et al. .
5,083,662 1/1992 Bishop et al. ..... 206/37.1
5,086,288 2/1992 Stramer .
5,156,032 10/1992 Edgar .
5,157,244 10/1992 Mroczkowski et al. .
5,195,341 3/1993 Nieuwkoop .
5,254,842 10/1993 Posner et al. .
5,307,658 5/1994 Kokubu et al. .
5,311,757 5/1994 Spahn .
5,326,964 7/1994 Risser ..... 235/487
5,331,325 7/1994 Miller ..... 341/176
5,337,043 8/1994 Gokcebay .
5,337,588 8/1994 Chhatwal .
5,347,267 9/1994 Murray .
5,351,042 9/1994 Aston .
5,367,295 11/1994 Gokcebay et al. .
5,397,884 3/1995 Saliga .
5,422,632 6/1995 Bucholtz .
5,423,198 6/1995 DiVito .
5,433,096 7/1995 Janssen et al. ..... 70/278

UNIVERSAL APPARATUS FOR USE WITH ELECTRONIC AND/OR MECHANICAL ACCESS CONTROL DEVICES

This is a continuation of application Ser. No. 08/404,879, filed Mar. 16, 1995, now abandoned.

BACKGROUND OF THE INVENTION

1. Field of the Invention

The present invention relates generally to apparatus for use in operating electronic and/or mechanical access control devices. In particular, the invention relates to an apparatus having a removable insert which may include an electronic module for cooperating with the reader of an electronic access control device.

2. Description of Relevant Art

Keys for operating mechanical locks and for being inserted into a passage to communicate with the reader of an electronic access device are known in the art. For example, U.S. Pat. No. 4,998,952, assigned to the same assignee as the present application, discloses a hybrid key having a key blade and a key bow, the key bow having secured thereto a housing which contains a circuit board. The circuit board is molded in the housing and the housing is removably secured to the key bow by flanges formed thereon and a rivet that passes through aligned openings in the housing and key bow. The key blade may have bitting surfaces cut therein for operating the pin tumblers of a cylinder-type lock, or it may be uncut and used as a guide for guiding the key to permit contact of the electronic components thereof with the detector or reader of an electronic access control device.

The Pat. No. 4,998,952 teaches replacement of the mechanical portion of the key, i.e., the key blade and bow, while permitting reuse of the more expensive housing and electronic component on a different key. Thus, for example, should someone in possession of the hybrid key lose that key, the mechanical locks operated by that key can be replaced or modified so that they are no longer operated by the lost key. As for the other keys which now do not operate the modified mechanical locks, the electronic component of such keys can be removed and positioned on new keys with bitted blades that operate the modified lock. In this manner, the security of the locks is maintained by replacing the key bow and blade while reusing the expensive electrical component of each key.

The key disclosed in the Pat. No. 4,998,952 is an electronic key and may have a bitted blade for operating a mechanical lock or a smooth blade for engaging the reader of an electronic access device.

This patent does not discuss the desirability of providing an apparatus for use in operating electronic access control devices which includes a removable insert secured to the apparatus by a separate housing, which insert may include an electronic component for cooperating with access control devices of varying types or levels of security, one such insert being replaceable with another insert which may contain different or additional electronic components.

This patent also does not discuss the desirability of providing a key for operating a mechanical lock only, which key may be subsequently upgraded to include an electronic portion for cooperating with an electronic access control device. Thus, assume it is desired to install an electronic access device at the outer entrance of a building when the doors inside the building have already been provided with mechanical locks operated by cut keys. It would be necessary to form new keys according to the Pat. No. 4,998,952, which keys would include a key blade and bow with an electronic housing (even though the cut blades of the new keys would correspond to the cut blades of the old keys). As such, installing an electronic access control device would result in increased key manufacturing costs.

There is a need in the art for an improved apparatus for operating electronic access control devices which apparatus may contain one of many interchangeable inserts having various types of electronic components. There also is a need in the art for an improved key for operating a mechanical lock which can be upgraded to operate the mechanical lock and the reader of an access control device.

SUMMARY OF THE INVENTION

The present invention provides an apparatus for use with an electronic access control device which may be in the form of a holder for receiving an insert containing an electronic component which may be hermetically sealed in the insert and cooperates with the reader or detector of the electronic access control device. The insert is secured to the holder by a clamshell cover which engages the insert and the holder to securely fix the insert within a recess formed in the holder. The cover can be disengaged to permit removal of the insert and replacement thereof with another insert which may have the same or a similar configuration as that of the removed insert but may contain a different electronic component which, for example, is designed to cooperate with an electronic access control device that utilizes a different technology to provide a higher (or lower) level of security.

The holder which removably receives the insert may be any of various devices. In one embodiment, the holder is a key-shaped member with an elongated guide blade for insertion into the slot of the reader of the access control device. In another embodiment, the holder is in the form of a key ring tag-like device with a recess in which the insert is secured by the cover. In yet another embodiment, the holder is a card or card-shaped member, for example, a photo I.D. card, with a recess or cut-out section in which the insert is secured by the cover. These, of course, are merely exemplary of the many different holder devices with which the invention may be used and carried out. Also, the type of electronic component contained in the insert may utilize any of various technologies.

The present invention also provides a key including a key bow with a portion thereof cut-out to form a recess, a key blade integral with and extending away from the key bow, and an insert removably disposed in the recess of the key bow. A clamshell housing is secured around the key bow so as to enclose the insert and secure the insert to the key. To modify the key, the insert is removed and replaced with an insert having an electronic component which, for example, operates a higher level access control device in a hierarchical system. The insert is designed to be removed only upon removal of the housing from the key bow, and the removal of the housing may be evident from tamper-indicating structure provided on the housing.

The insert may be a dummy insert when used with a key for a mechanical lock to provide an upgrade path should the user desire to install a higher level of security, e.g., a reader operated electronic access control device. In that case, an insert which has an electronic module hermetically sealed therein may be positioned in the recess of the key bow in lieu of the dummy insert. For example, bitted keys for operating a system with mechanical locks may be provided with dummy inserts secured to the key bow by the clamshell housing. Should it subsequently be desired to upgrade the lock system to provide an additional level of security, such as a door secured by an electronic access control device, it is only necessary to replace the dummy inserts in the keys with inserts including suitable electronic components, thereby upgrading the keys to operate the mechanical lock and the electronic access control device.

BRIEF DESCRIPTION OF THE DRAWINGS

Other features, benefits and advantages of the present invention will be apparent from the following description of preferred embodiments thereof, taken in conjunction with the accompanying drawings, wherein.

DETAILED DESCRIPTION OF PREFERRED EMBODIMENTS

Figure 1B:
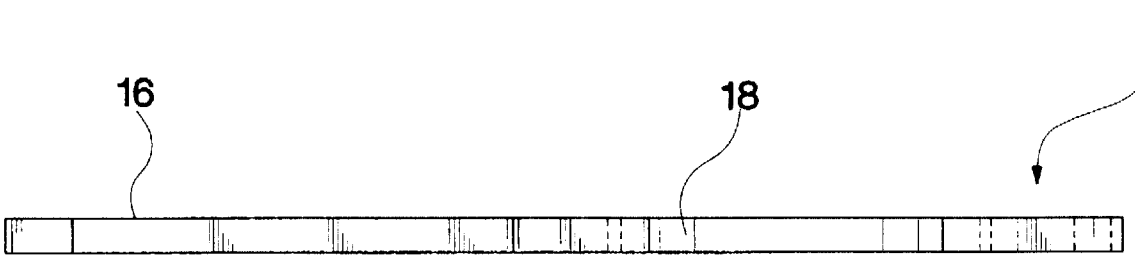
FIGS. 1A and 1B are, respectively, a front elevation view and a plan view of a holder apparatus for receiving an insert according to a first embodiment of the present invention.
Figure 1A:
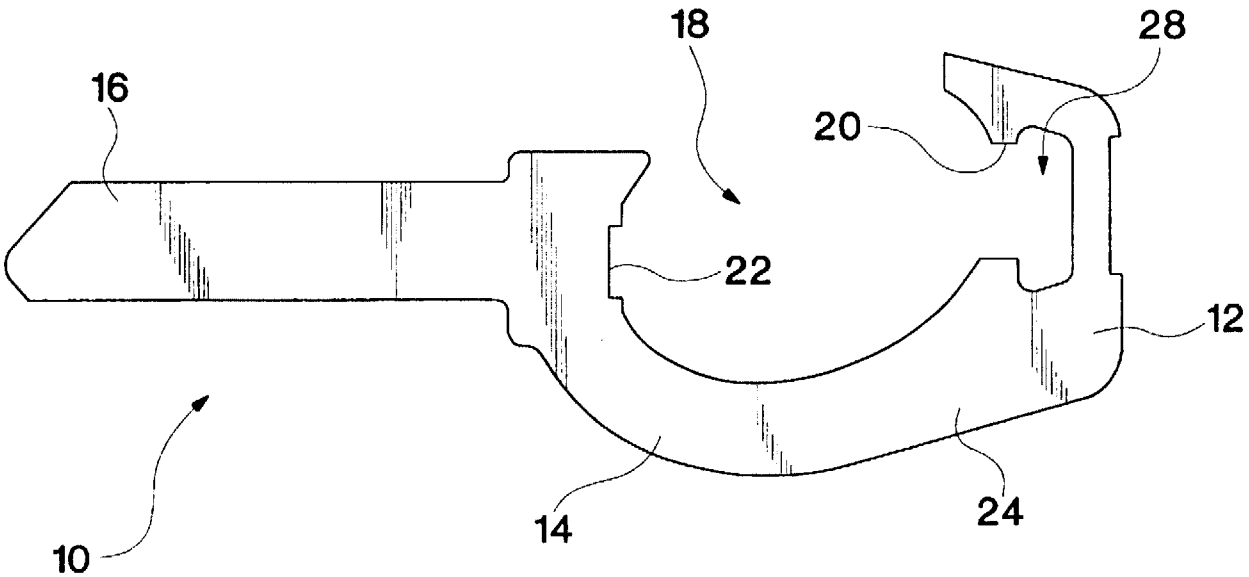

With reference to FIGS. 1A and 1B, a holder apparatus which forms part of the present invention is indicated generally by the reference numeral 10 and is in the form of a key-shaped member that includes a bow portion 12 in the form of a frame 14, and a blade portion 16. As seen in the Figures, the blade 16 is configured for use as a guide for insertion into the reader or detector of an electronic access control device. However, the blade 16 may be in the form of a key blank which is configured to fit within the keyway of a mechanical lock and adapted to be cut by a locksmith, for example, to provide bitting surfaces thereon for operating the tumbler pins of a cylinder-type lock as is known in the art.

The bow 12 of the holder 10 includes a cut-out section or recess 18 which results in the bow having essentially the shape of a frame 14. The recess 18 is preferably oval-shaped but it will be recognized that other shapes may be used as well. The shape of the recess 18 preferably corresponds to the shape of the insert 30 so that the insert is received in the recess in a relatively snug fashion. The bow 12 includes a first notched portion 20 and a second notched portion 22 which cooperate with the insert 30 as will be described below. An opening 28 is provided on the bow at the end disposed away from the blade 16 which, upon placement of the insert 20 in the recess 18, forms an aperture for mounting the holder on a ring, chain, etc.

Figure 2C:
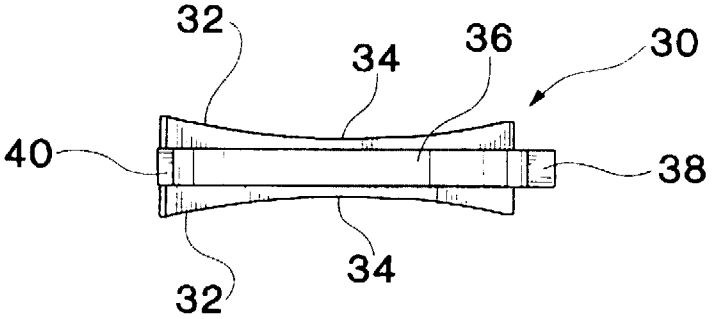
FIGS. 2A, 2B and 2C are, respectively, front and side elevation views and a plan view of an insert according to the present invention.
Figure 2A:
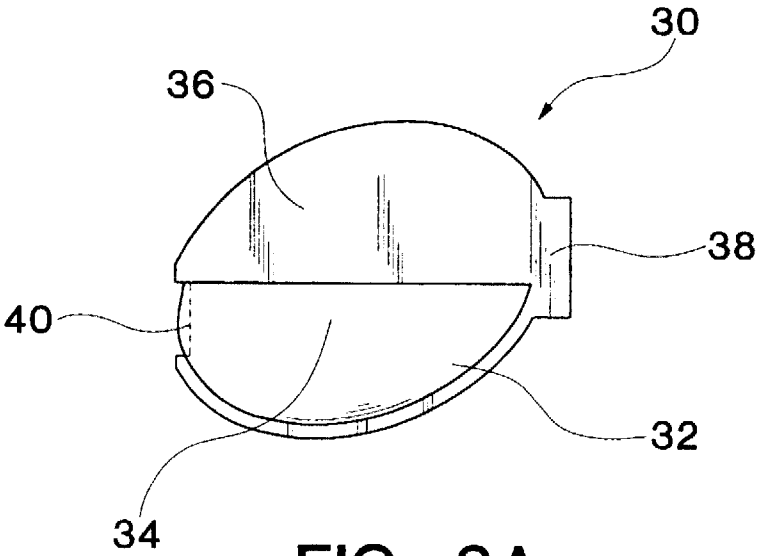
Figure 2B:
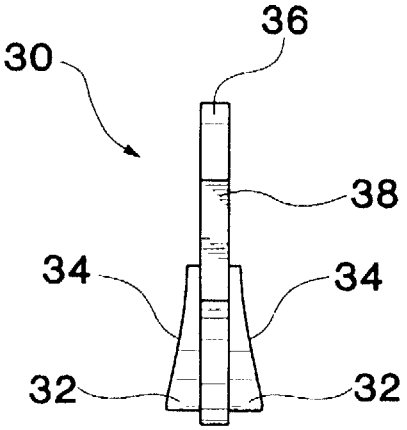

FIGS. 2A–2C show an insert indicated generally by the reference numeral 30 which is configured to be received in the recess 18 of the holder 10. The insert 30 may be a dummy insert that does not include an electronic module or the like therein which is preferably formed as a solid plastic molded member. That is, a dummy insert 30, although having an appearance which is the same as that of an insert containing electronic components for operating an electronic access control device, is electronically non-functional. As will be described below, according to one embodiment of the invention, the dummy insert is included with a key blank which is cut to form a key which operates a mechanical lock and, should the user subsequently desire to incorporate an electronic access control device and have the key also operate the access device, such structure provides an upgrade path in that the dummy insert 30 can be replaced with an insert containing various electronic components—depending on the level or type of security of the electronic access control device to be installed.

In a preferred embodiment, the electronic components are hermetically sealed in the body of the insert. This could be accomplished, e.g., by ultrasonically welding two insert halves together with the electronics module disposed and sealed therebetween. Alternatively, the electronics could be placed in a suitable mold and the insert then molded so as to completely enclose the electronics. Those skilled in the art will appreciate that other methods for forming the insert 30 may be used as well and those mentioned above are only non-limiting examples of preferred embodiments.

The insert 30 comprises lower and upper halves with the lower half including thickened portions 32 on each side of the insert, and the upper half including a more narrow portion 36 defining flat faces on each side of the insert. The thickened portions 32 each include a depression 34 configured to be engaged by the fingers of a person using the holder. See FIG. 2B. The portions 32 of the insert 30 provide an area for receiving indicia which may relate to the specific holder, advertising information, etc. For example, when the holder is a key blank and a dummy insert is used, this area on one side of the insert may carry a message regarding potential upgrading of the key for use in a hierarchical system. The area on the other side of the insert also may carry indicia. The indicia may be printed on a label or film that is suitably adhered to the outer surfaces of the insert 30, it may be molded into the insert, etc. At one end of the insert 30 a projection 38 is provided the shape of which is preferably rectangular and corresponds to the shape of the notch 20 formed in the bow 12 of the holder 10. The opposite end of the insert 30 has a notched recess 40 which cooperates with a cover member 50 to secure the insert to the holder 10, as will be described below.

Figure 3A:
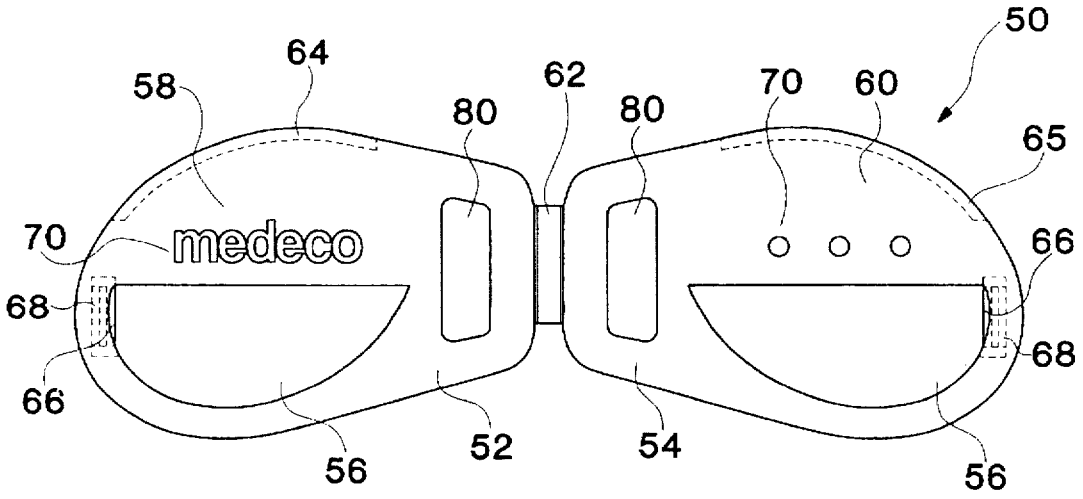
FIGS. 3A, 3B and 3C are, respectively, a front elevation view, a rear elevation view, and a plan view of a housing according to the present invention.
Figure 3B:
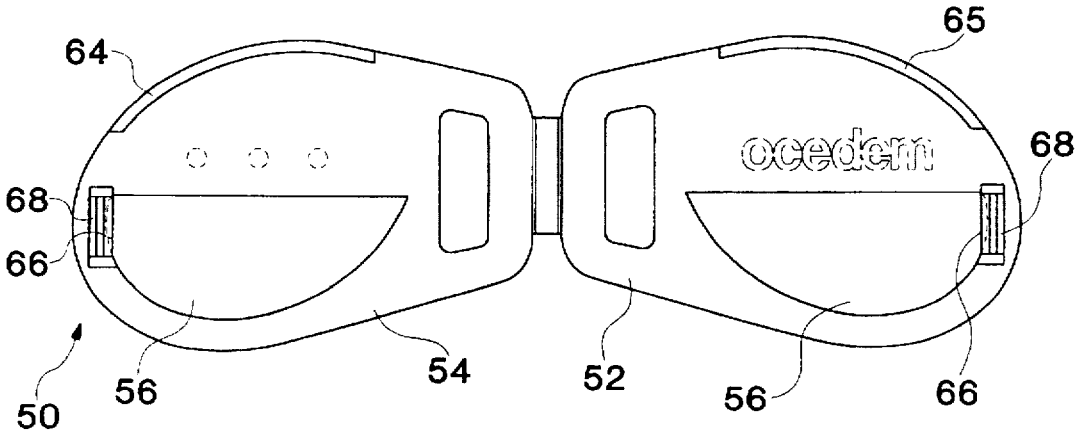
Figure 3C:
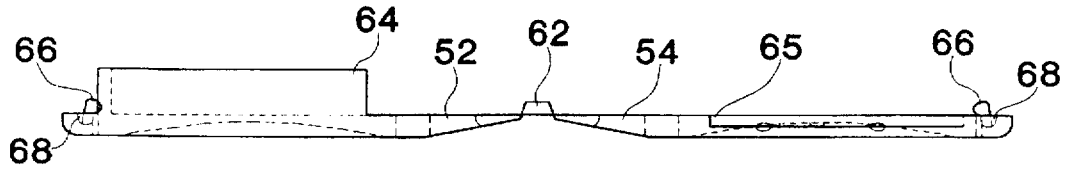

Turning now to FIGS. 3A to 3C, a cover member for securing the insert 30 to the holder 10 is indicated generally at reference numeral 50 and is in the form of a clamshell member with two portions or halves 52 and 54. The cover 50 preferably is made of any suitable plastic material. The two halves 52, 54 are joined to each other by a semi-flexible connection 62, which may be a plastic hinge connection. The hinge preferably is flexible enough to permit folding of the cover 50 about the holder 10, yet rigid enough to securely lock against the insert 30 and holder 10. The cover 50 is adapted to be closed around the bow 12 of holder 10 so as to sandwich the insert 30, which has been previously positioned in the recess 18 of holder 10, thereby locking the cover 50 to the insert and the holder, as will be described further below.

Each of the portions 52, 54 includes a window or opening 56 passing therethrough in which are received the respective thickened portions 32 of insert 30. Surfaces 58, 60 are respectively disposed on portions 52, 54 and are formed with a depression for receiving the fingers of a person using the holder. Upon assembly of the insert 30 and cover 50 on the holder 10, the surfaces 58, 60 of cover 50 preferably are flush with the thickened portions 32 of insert 30 and the depressions 34 thereof (disposed in windows 56) to form a continuous depression. The surfaces 58, 60 may be used to receive various types of indicia 70 as seen in FIG. 3A, which indicia may be molded into the cover or applied to the surface thereof. Each of the portions 52, 54 includes an opening 80, and these openings 80 overlie each other and surround the aperture 28 of holder 10 upon assembly of the components so as to form an opening for receiving a key ring or the like element.

A pair of ridges 64, 65 are respectively formed along the upper ends of portions 52, 54 (FIGS. 3B and 3C) and extend across the cut-out portion of holder 10 to close off the border of recess 18 when the cover 50 is secured thereto. The specific configuration of the ridges 64, 65 is not critical as they form a seam along the upper end of the cover 50. The ridges may overlap each other, meet in an end-to-end manner, etc. The portions 52, 54 of cover 50 have semi-flexible tangs 66 formed at the ends thereof which are disposed away from the hinge 62. As seen in FIG. 3C, the tangs 66 are somewhat L-shaped and are located in notches 68 formed in the rear side of portions 52, 54. The notches 68 permit the tangs 66 to flex or move a limited amount when securing the cover 50 to the insert 30 and holder 10.

Figure 5B:
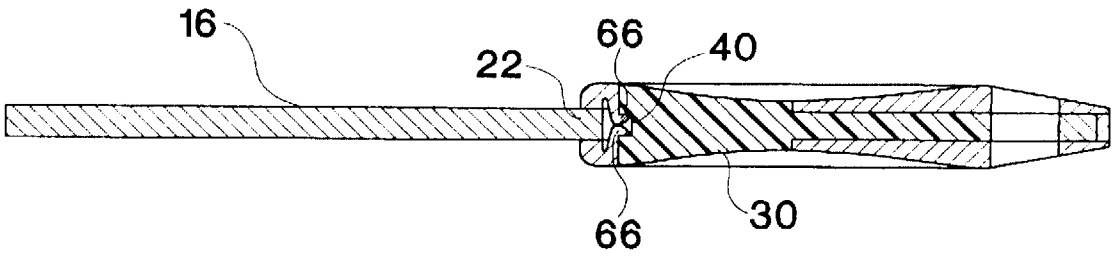
FIGS. 5A and 5B are, respectively, a front elevation view, and a sectional view taken along lines X—X in FIG. 5A, of an assembled apparatus for operating an electronic access control device according to the present invention.
Figure 5A:
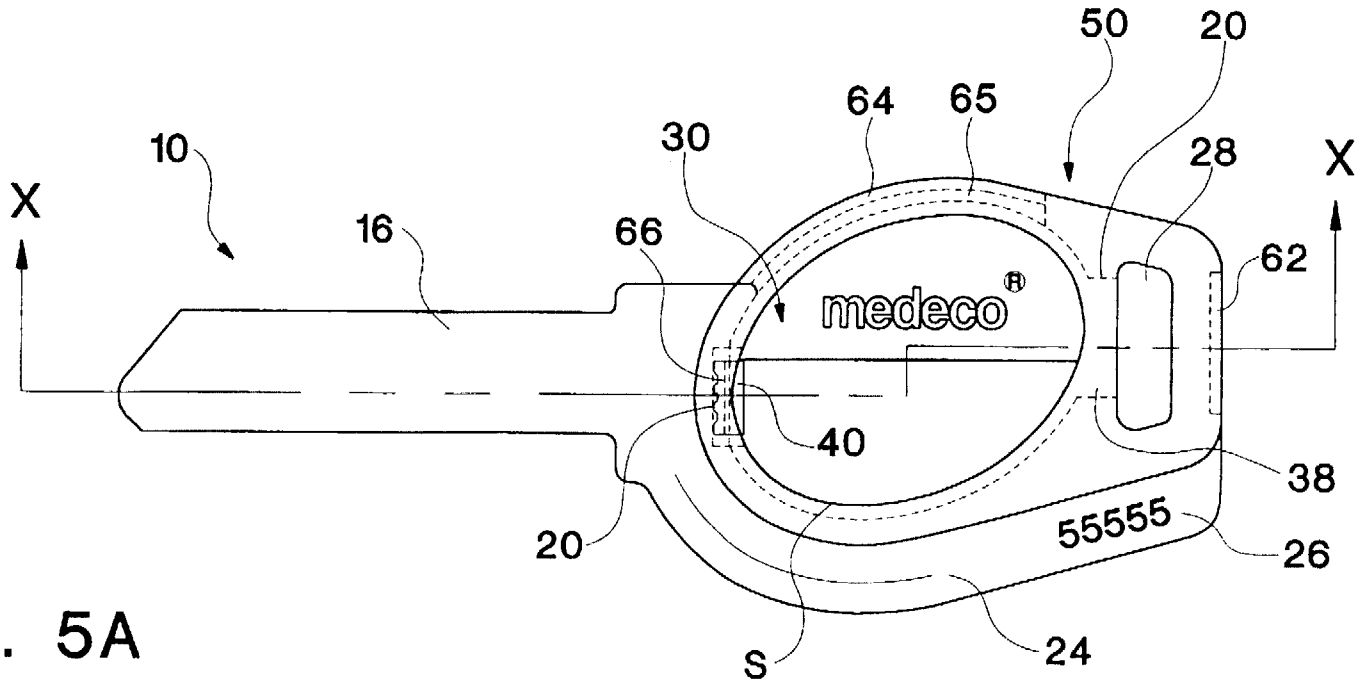

When the cover 50 is closed around the bow 12 of holder 10 with the insert 30 positioned in recess 18, the tangs 66 engage the notch 40 of the insert 30 in a snap-fit fashion. In this position, the tangs 66 are held in the groove 40 of insert 30 by the holder 10, i.e., the groove 22 in holder 10 forces the tangs 66 against the notch 40 of insert 30 to prevent disassembly of the apparatus. As seen in FIG. 5A, when assembled the tangs are hidden from view by the cover 50 and insert 30 which meet along a seam S. Thus, the tangs are not accessible after assembly of the apparatus. However, the cover may be removed by an authorized person using a tool or by an unauthorized person using sufficient force to fracture or tear the plastic cover.

The invention preferably includes a tamper-indicating feature, which may be provided by the arrangement of the tangs 66 which are not accessible once the apparatus has been assembled. In particular, once assembled, the hinge 62 of cover is cut to remove the cover 50 and replace the insert 30, e.g., to upgrade the apparatus such that it is capable of operating a different electronic access control device. Once the hinge 62 is cut, the portions 52, 54 can be pivoted about the tangs 66 to release the latter from the notch 40 in insert 30 and the notch 22 in holder 10. It will be recognized that other tamper-indicating structure could be utilized, including, but not limited to, forming the cover of a plastic which becomes discolored when subjected to the stress arising during prying or other unauthorized attempts to disassemble the key. This feature indicates when the cover has been removed and ensures that only authorized individuals perform the conversion of the keys by replacing the inserts thereof.

In another embodiment, the holder is a key blank adapted to be cut so as to operate a mechanical lock and having a dummy insert secured thereto. The key blank could be adapted to cooperate with any type of lock with means for being operated mechanically by inserting a key into the lock. For example, the lock could be a Medeco® type cylinder lock with rotatable pin tumblers which are engaged by bitting surfaces formed on the key blade. However, the invention is not limited to any specific type of mechanical lock in that the ability to upgrade a key for a mechanical lock to a key for operating an access control device does not depend on the particular mechanics of the lock but, rather, is facilitated by providing the key with structure for securing an insert thereto.

In order to upgrade the key (formed from the key blank) for operating a mechanical lock so that it operates an electronic access control device, the dummy insert is removed from the key and replaced with an insert containing an electronic component which cooperates with and controls the reader or detector of said access control device. In a preferred embodiment, the dummy insert and the insert with an electronic component have a substantially identical outer appearance; however, persons skilled in the art will appreciate that such similarity in appearance is not necessary to practice the present invention.

Figure 4:
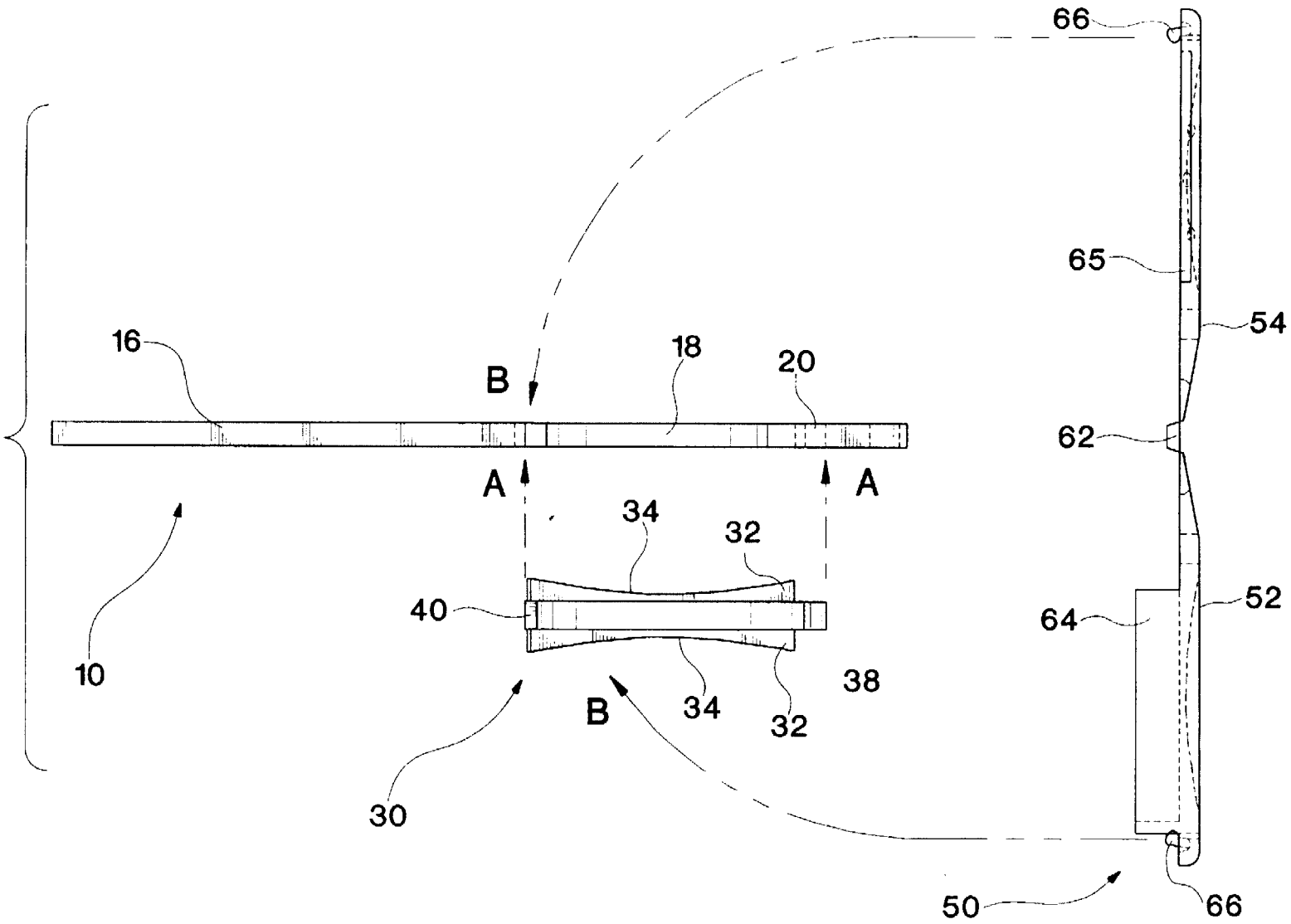
FIG. 4 is an exploded view showing the manner in which the holder of FIGS. 1A and 1B, the insert of FIGS. 2A, 2B and 2C, and the housing of FIGS. 3A, 3B and 3C are assembled.

FIG. 4 shows the manner in which the apparatus is assembled. The insert 30 is positioned within the holder recess 18 as indicated by arrows A. The cover 50 then is folded about the bow of holder 10 as indicated by arrows B. Upon closing together the cover portions 52, 54, the tangs 66 snap into the notch 40 of insert 30 and the inner surfaces of portions 52, 54 abut the outer side surfaces of the holder bow 12. The resulting structure provides a sturdy assembly with a sleek and smooth appearance. In addition, engagement of the cover 50 with the insert 30 and holder 10 leaves a portion 24 of holder bow 12 exposed for receiving indicia 26 which may relate to, e.g., customer specific advertising, information concerning potential upgrade if the holder is a key, etc.

Figure 6:
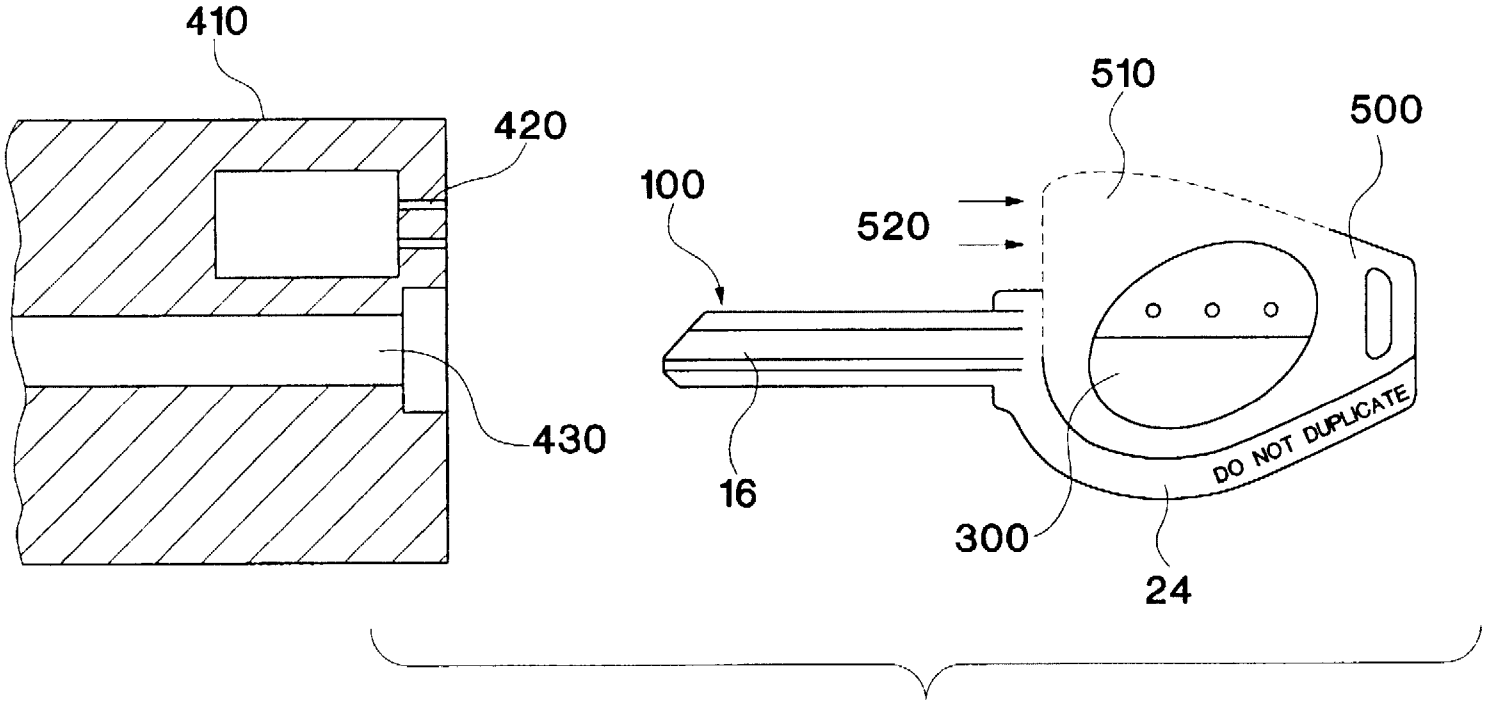
FIG. 6 is a front elevation view of a holder apparatus according to another embodiment of the present invention.

FIG. 6 shows an embodiment of the present invention which includes a key blank 100, an insert 300, and a cover 500. The insert 300 has embedded therein an electronic module which may contain different electronic components for cooperating with the circuit connectors or contacts 420 of the reader 410 of an electronic access control device when the blade of the key blank (or key after the blank is cut) is inserted into the passage 430 of reader 410. The insert 300 may contain a solid state memory, transmitter, receiver, microprocessor, etc., the specific components depending on the technology being utilized. In the embodiment of FIG. 6, the key may simply have data which is read by the detector to determine whether operation of the access control device is authorized. Many different technologies may be used to provide the additional level of access control. The cover 500 includes an enlarged portion 510 with electronic contacts indicated at 520 that engage contacts 420 provided on the reader or detector 410 of the electronic access control device upon insertion of key blade 16 into passage 430. The contacts 420, 520 may be electronic, optical, etc.

For example, in further embodiments the insert may have means for cooperating with the reader of the access control device to provide proximity based control such that moving the key within a preselected distance activates the access control device (and thus it is not necessary to position a guide blade in the passage of a reader such as 430). The insert may have a transmitter to indicate the location of the key to monitor the key's location and prevent the key from leaving a certain area. Those skilled in the art will recognize that various technologies may be utilized depending on the desired application of the present invention.

It should be recognized that the shape of the cover of the apparatus of the present invention is not limited to those shapes disclosed herein but, on the contrary, can be varied to accommodate different reader or detector configurations, or to accommodate inserts having a shape different than those of inserts 30 or 300. Also, the inserts could be color-coded to indicate a particular type or level of security, a particular insert or cover configuration, or other characteristics of the apparatus.

Figure 7B:
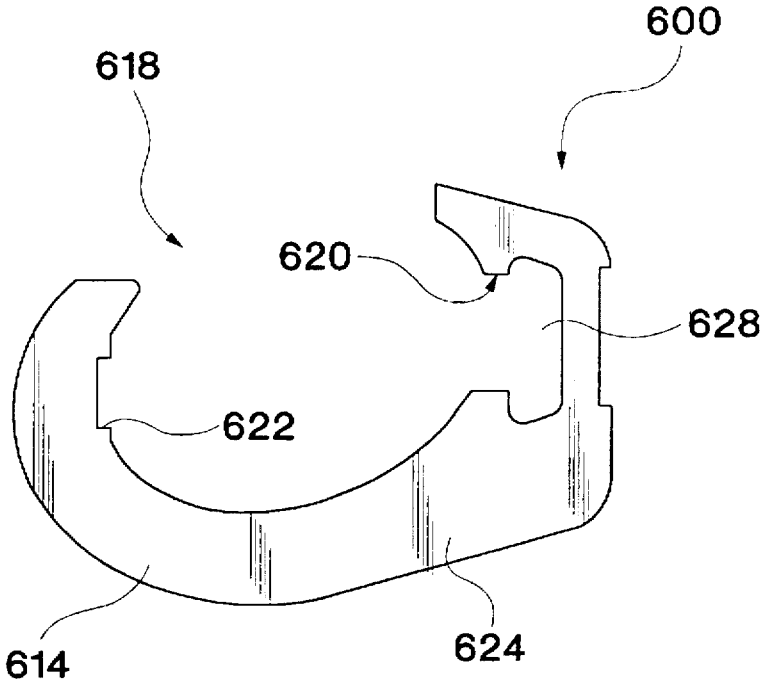
FIGS. 7A and 7B are elevation views of further embodiments of the holder apparatus according to the present invention.
Figure 7A:
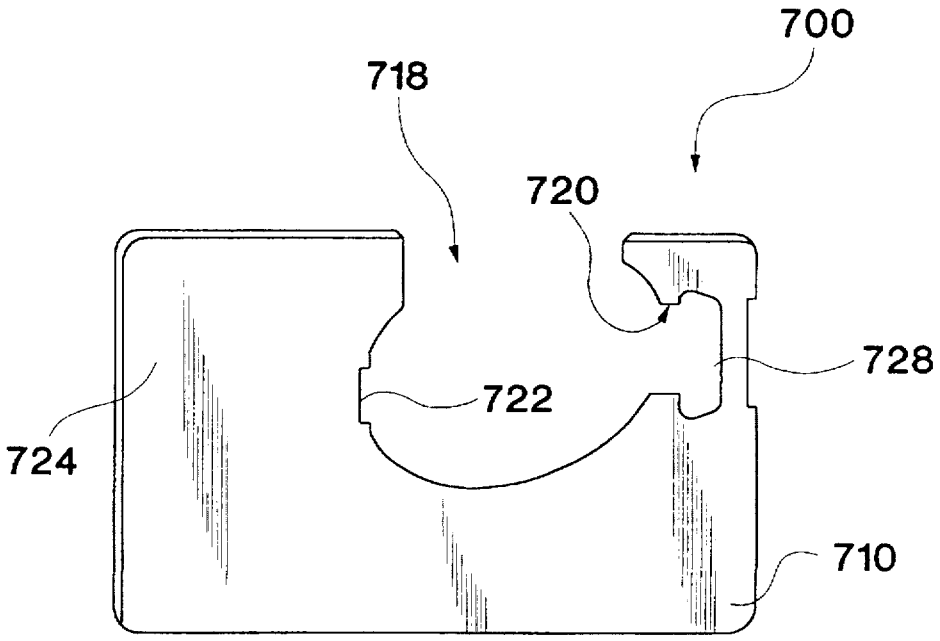

FIG. 7A depicts another embodiment of the apparatus of the present invention in which the holder is in the form of a card-like member 700. The card 700 includes a flat body 710 with a recess 718 configured to the receive the insert containing the electronic component in a manner similar to that described above with respect to the previous embodiments. The holder 700 includes first and second notched portions 720, 722 as well as an opening 728 which serve a purpose as described in the previous embodiments. The holder 720 has a portion 724 which may receive a photograph, for example, if the holder is used as photo I.D. The portion or area 724 may also be used to carry indicia if desired. The insert is secured to the holder 700 by a cover as discussed in connection with the previous embodiments.

FIG. 7B depicts yet another embodiment 600 of the apparatus of the present invention in which the holder is in the form of a key ring tag-like member 614 which includes a recess 618 for receiving an insert secured thereto by a cover as in the above-described embodiments. The holder 600 also includes first and second notched portions 620, 622, opening 628, and frame area 624, which may function as in the previous embodiments and, therefore, will not be described in detail here. The holders shown in FIGS. 7A and 7B are but two examples of many different possible configurations of the present invention.

It is apparent that the present invention provides an apparatus for use with electronic access control devices which includes a holder for receiving a removable insert that contains an electronic component(s) for cooperating with and operating the access control device. Further, the invention provides a key blank or key for use with mechanical locks and electronic access control devices in which the key blade and bow are combined with a removable, reusable insert which may be a dummy insert or may have incorporated therein an electronic module. It is further apparent that the invention provides a method of upgrading a key for operating a mechanical lock to a key which also operates an electronic access control device, e.g., a reader located at an outer entrance of a building, by substituting an insert with electronic components for the dummy insert. It will be appreciated that the invention is not limited for use with any particular type of holder or key blank and, as such, may be used with many types of holders as well as key blanks and keys sold by various manufacturers.

Other features and advantages of the present invention will readily occur to those skilled in the art, as will many modifications and alterations in the preferred embodiments of the invention described herein, all of which may be achieved without departing from the spirit and the scope of the invention as defined by the appended claims.

What is claimed is:

1. A system of locks and keys in which a key for operating a mechanical lock may be upgraded to a key for operating the mechanical lock and an electronic access control device, the system comprising:

at least one mechanical lock operable by a key having a blade which is insertable into the mechanical lock;

at least one electronic access control device including a reader which communicates with an electronic module to operate the access control device;

the key including a blade and a key bow, the key having a recess formed therein with a first modular insert removably positioned within the recess and secured to the key, the first modular insert being a dummy insert which does not contain an electronic component;

a second modular insert containing an electronic module which communicates with the reader of the electronic access control device to operate the access control device;

said second modular insert configured to be removably positioned within the recess of the key by removing the first modular insert from the key and replacing the first modular insert disposed in the recess of the key with the second modular insert, and then securing the second modular insert thereto;

whereby the key operates the mechanical lock and the second modular insert cooperates with the reader of the electronic access control device to permit the key also to operate the electronic access control device; and wherein said second modular insert contains all electronic components for said key, such that when said second modular insert is removed said key is free of any electronic components.

2. A system according to claim 1, wherein the mechanical lock includes pin tumblers engaged by the blade of the key.

3. A system according to claim 1, wherein the electronic module is sealed within the second modular insert and is substantially unexposed to the environment.

4. A system according to claim 1, wherein the first and second modular inserts have a substantially identical outer appearance.

5. The system according to claim 1, wherein said key bow has generally flat opposite sides and a width between said opposite sides, said recess extends entirely through said width of said key bow, and said first modular insert and said second modular insert each have a larger width than said width of said key bow such that when positioned within said recess the modular insert extends outward from said sides of said key bow.

6. A system of locks and keys in which a key for operating a mechanical lock may be upgraded to a key for operating the mechanical lock and an electronic access control device, the system comprising:

at least one mechanical lock operable by a key having a blade which is insertable into the mechanical lock;

at least one electronic access control device including a reader which communicates with an electronic module to operate the access control device;

the key including a blade and a key bow, the key having a recess formed therein with a first modular insert removably positioned within the recess and secured to the key;

a second modular insert containing an electronic module which communicates with the reader of the electronic access control device to operate the access control device;

said second modular insert configured to be removably positioned within the recess of the key by removing the first modular insert from the key and replacing the first modular insert disposed in the recess of the key with the second modular insert, and then securing the second modular insert thereto;

whereby the key operates the mechanical lock and the second modular insert cooperates with the reader of the electronic access control device to permit the key to also operate the electronic access control device, wherein the first modular insert contains an electronic component for operating a first electronic access control device and the second modular insert contains an electronic component for operating a second electronic control device, whereby after replacement of the first modular insert with the second modular insert the key will operate the mechanical lock and the second electronic access control device, and wherein said first and second modular inserts contain all electronic components for said key, such that when said first and second modular inserts are removed, said key is free of any electronic components.

7. The system according to claim 6, wherein said key bow has generally flat opposite sides and a width between said opposite sides, said recess extends entirely through said width of said key bow, and said first modular insert and said second modular insert each have a larger width than said width of said key bow such that when positioned within said recess the modular insert extends outward from said sides of said key bow.

8. A method of upgrading a key which operates a mechanical lock into a key that cooperates with a reader of an electronic access control device so as to operate the electronic access control device, the method comprising steps of:

providing a key having a key bow, a key blade extending from the key bow for operating the mechanical lock, the key being free of any electronic components and including a portion to which a first modular insert is removably secured, the first modular insert being a dummy insert which does not contain an electronic component;

removing the first modular insert from the key;

providing a second modular insert having an electronic module for cooperating with and operating the electronic access control device;

securing the second modular insert to the key;

whereby the key with the second modular insert secured thereto which has the electronic module will operate the mechanical lock and will cooperate with and operate the electronic access control device, and said second modular insert contains all electronic components for said key, such that when said second modular insert is removed said key is free of any electronic components.

9. A method of upgrading a key according to claim 8, wherein the key operates pin tumblers located in the mechanical lock.

10. A method of upgrading a key according to claim 8, wherein the electronic module is sealed within the second modular insert so as to be substantially unexposed to the environment.

11. A method of upgrading a key according to claim 8, wherein the first and second modular inserts have a substantially identical outer appearance.

12. A method of upgrading a key according to claim 8, further comprising the step of securing either of the first and second modular inserts to the key with portions that extend over opposite side surfaces of said key bow so as to hold the insert in said recess.

13. A method of upgrading a key according to claim 12, wherein the clamshell-shaped cover includes a tamper-evident means for indicating that the cover has been removed from the key by an unauthorized person.

14. A method of upgrading a key which operates a mechanical lock into a key that cooperates with a reader of an electronic access control device so as to operate the electronic access control device, the method comprising steps of:

providing a key having a key bow, a key blade extending from the key bow for operating the mechanical lock, the key being free of any electronic components and including a portion to which a first modular insert is removably secured;

removing the first modular insert from the key;

providing a second modular insert having an electronic module for cooperating with and operating the electronic access control device;

securing the second modular insert to the key;

whereby the key with the second modular insert secured thereto which has the electronic module will operate the mechanical lock and will cooperate with and operate the electronic access control device, wherein the first modular insert contains an electronic component for operating a first electronic access control device and the second modular insert contains an electronic component for operating a second electronic control device, whereby after replacement of the first modular insert with the second modular insert the key will operate the mechanical lock and the second electronic access control device, and wherein said first and second modular inserts contain all electronic components for said key, such that when said first and second modular inserts are removed, said key is free of any electronic components.

* * * * *

UNITED STATES PATENT AND TRADEMARK OFFICE

CERTIFICATE OF CORRECTION

PATENT NO. : 5,775,148

DATED : July 7, 1998

INVENTOR(S) : Tim W. Layton et al.

It is certified that error appears in the above-indentified patent and that said Letters Patent is hereby corrected as shown below:

n the Claims: Col. 10, line 10 (claim 13), delete "wherein the lamshell-shaped cover includes" and insert -- further including -; Col. 10, line 11 (claim 13), delete "cover" and insert -- irst or second modular insert --.

Signed and Sealed this

Thirteenth Day of July, 1999

*Attest:*

*Attesting Officer*

Q. TODD DICKINSON

*Acting Commissioner of Patents and Trademarks*